US008511112B2

(12) United States Patent
Kakuda et al.

(10) Patent No.: US 8,511,112 B2
(45) Date of Patent: Aug. 20, 2013

(54) REFRIGERATION CYCLE APPARATUS

(75) Inventors: Masayuki Kakuda, Chiyoda-ku (JP); Fumihiko Ishizono, Chiyoda-ku (JP); Hideaki Nagata, Chiyoda-ku (JP); Naofumi Takenaka, Chiyoda-ku (JP); Takashi Okazaki, Chiyoda-ku (JP); Mihoko Shimoji, Chiyoda-ku (JP); Shin Sekiya, Chiyoda-ku (JP); Toshihide Koda, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/320,849

(22) PCT Filed: May 28, 2010

(86) PCT No.: PCT/JP2010/003584
§ 371 (c)(1),
(2), (4) Date: Nov. 16, 2011

(87) PCT Pub. No.: WO2010/140324
PCT Pub. Date: Dec. 9, 2010

(65) Prior Publication Data

US 2012/0060548 A1 Mar. 15, 2012

(30) Foreign Application Priority Data

Jun. 2, 2009 (JP) ..... 2009-132722

(51) Int. Cl.
*F25B 1/00* (2006.01)

(52) U.S. Cl.
USPC ..... 62/498; 62/510; 62/511

(58) Field of Classification Search
USPC ..... 62/498, 204, 210, 222, 228.1, 510, 62/511, 513; 418/55.1
See application file for complete search history.

(56) References Cited

U.S. PATENT DOCUMENTS 2,663,169 A * 12/1953 Twomey ..... 62/630
4,745,777 A 5/1988 Morishita et al.

(Continued)

FOREIGN PATENT DOCUMENTS

CN 1808016 A 7/2006
CN 101014812 A 8/2007

(Continued)

OTHER PUBLICATIONS

Extended European Search Report Issued Sep. 17, 2012 in Patent Application No. 10783112.5.

(Continued)

*Primary Examiner* — Melvin Jones
(74) *Attorney, Agent, or Firm* — Oblon, Spivak, McClelland, Maier & Neustadt, L.L.P.

(57) ABSTRACT

A refrigeration cycle apparatus which is capable of performing matching of the volumetric flow rate without performing pre-expansion it obtained. A refrigeration circuit includes a compression unit including a main compressor and a second compressor, a gas cooler, an expansion mechanism, and an evaporator interconnected with pipes, and a sub-compression mechanism driven by power recovered by the expansion mechanism, a suction side of the sub-compression mechanism is connected to a compression process of the compression unit, a discharge side of the sub-compression mechanism is connected to an inlet side of the gas cooler, and flow rate of refrigerant flowing into the sub-compression mechanism is controlled.

8 Claims, 9 Drawing Sheets

(56) References Cited

U.S. PATENT DOCUMENTS

| | | | |
|---|---|---|---|
| 5,833,446 | A | 11/1998 | Smith et al. |
| 6,321,564 | B1 | 11/2001 | Yamanaka et al. |
| 6,644,045 | B1 | 11/2003 | Tang et al. |
| 2001/0037653 | A1 | 11/2001 | Yamanaka et al. |
| 2004/0250556 | A1 | 12/2004 | Sienel |

FOREIGN PATENT DOCUMENTS

| | | | |
|---|---|---|---|
| EP | 1 416 231 | A1 | 5/2004 |
| JP | 58 188557 | | 12/1983 |
| JP | 2000 234814 | | 8/2000 |
| JP | 2000 329416 | | 11/2000 |
| JP | 2003 279179 | | 10/2003 |
| JP | 2004-108683 | A | 4/2004 |
| JP | 2004 150750 | | 5/2004 |
| JP | 2005 291622 | | 10/2005 |
| WO | 97 28354 | | 8/1997 |
| WO | 2005 019743 | | 3/2005 |
| WO | WO 2007/023599 | A1 | 3/2007 |

OTHER PUBLICATIONS

International Search Report Issued Jul. 20, 2010 in PCT/JP10/03584 filed May 28, 2010.

Chinese Office Action issued May 10, 2013 in Chinese Patent Application No. 201080024255.1 w/English translation.

* cited by examiner

| | RATED COOLING | INTERMEDIATE COOLING | RATED HEATING | INTERMEDIATE HEATING | |
|---|---|---|---|---|---|
| PRESSURE BEFORE EXPANSION | 10.64 | 9.21 | 9.86 | 7.75 | [MPa] |
| TEMPERATURE BEFORE EXPANSION | 20.2 | 24.9 | 32.5 | 26.1 | [℃] |
| PRESSURE AFTER EXPANSION | 4.15 | 5.00 | 4.29 | 3.82 | [MPa] |
| TEMPERATURE AFTER EXPANSION | 6.8 | 14.3 | 8.1 | 3.6 | [℃] |
| SUCTION PRESSURE | 4.09 | 4.98 | 3.46 | 3.61 | [MPa] |
| SUCTION TEMPERATURE | 9.6 | 17.4 | −0.2 | 1.4 | [℃] |
| DISCHARGE PRESSURE | 10.85 | 9.28 | 9.90 | 7.76 | [MPa] |
| DISCHARGE TEMPERATURE | 96.2 | 72.1 | 91.7 | 69.6 | [℃] |
| σvEC | 0.170 | 0.176 | 0.238 | 0.196 | |
| C.O.P.th | 3.36 | 4.92 | 4.17 | 5.94 | |
| RATIO | 100.0% | 100.0% | 100.0% | 100.0% | |

FIG. 5

| | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH RATED COOLING | PRE- EXPANSION RATIO y | 0% | 0% | 0% | 0% |
| | BYPASS RATIO x | 0% | 4.0% | 31.3% | 15.9% |
| | INTERMEDIATE PRESSURE Pm | 10.14 [MPa] | 8.87 [MPa] | 9.40 [MPa] | 7.45 [MPa] |
| σvEC*=0.170 | C.O.P. RATIO | 112.2% | 111.1% | 106.0% | 106.2% |

| | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH INTERMEDIATE COOLING | PRE- EXPANSION RATIO y | 35% | 0% | 0% | 0% |
| | BYPASS RATIO x | 0% | 0% | 28.9% | 13.0% |
| | INTERMEDIATE PRESSURE Pm | 10.41 [MPa] | 8.81 [MPa] | 9.43 [MPa] | 7.49 [MPa] |
| σvEC*=0.176 | C.O.P. RATIO | 107.2% | 112.9% | 105.5% | 105.3% |

| | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH RATED HEATING | PRE- EXPANSION RATIO y | | | 0% | 49.7% |
| | BYPASS RATIO x | | | 0% | 0% |
| | INTERMEDIATE PRESSURE Pm | | | 8.90 [MPa] | 7.40 [MPa] |
| σvEC*=0.238 | C.O.P. RATIO | | | 112.8% | 107.3% |

| | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH INTERMEDIATE HEATING | PRE-EXPANSION RATIO y | | | 0% | 0% |
| | BYPASS RATIO x | | | 19.2% | 0% |
| | INTERMEDIATE PRESSURE Pm | | | 9.15 [MPa] | 7.13 [MPa] |
| σvEC*=0.196 | C.O.P. RATIO | | | 109.2% | 113.6% |

FIG. 6

Wmax=100%

| | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH RATED COOLING | PRE- EXPANSION RATIO y | 0% | 0% | 0% | 0% |
| | BYPASS RATIO x | 0% | 4.0% | 31.3% | 15.9% |
| | DIVERSION RATIO w | 100% | 100% | 100% | 100% |
| | INTERMEDIATE PRESSURE Pm | 10.14 [MPa] | 8.87 [MPa] | 9.40 [MPa] | 7.45 [MPa] |
| σvEC*=0.170 | C.O.P. RATIO | 112.2% | 111.1% | 106.0% | 106.2% |

| | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH INTERMEDIATE COOLING | PRE- EXPANSION RATIO y | 0% | 0% | 0% | 0% |
| | BYPASS RATIO x | 0.0% | 0% | 28.9% | 13.0% |
| | DIVERSION RATIO w | 96.5% | 100.0% | 100.0% | 100.0% |
| | INTERMEDIATE PRESSURE Pm | 10.15 [MPa] | 8.81 [MPa] | 9.43 [MPa] | 7.49 [MPa] |
| σvEC*=0.176 | C.O.P. RATIO | 111.5% | 112.9% | 105.5% | 105.3% |

| | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH RATED HEATING | PRE- EXPANSION RATIO y | 0% | 0% | 0% | 0% |
| | BYPASS RATIO x | 0% | 0% | 0% | 0% |
| | DIVERSION RATIO w | 70.7% | 74.4% | 100% | 81.7% |
| | INTERMEDIATE PRESSURE Pm | 10.03 [MPa] | 8.93 [MPa] | 8.90 [MPa] | 7.06 [MPa] |
| σvEC*=0.238 | C.O.P. RATIO | 109.5% | 106.7% | 112.8% | 111.9% |

| | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH INTERMEDIATE HEATING | PRE- EXPANSION RATIO y | 0% | 0% | 0% | 0% |
| | BYPASS RATIO x | 0% | 0% | 19.2% | 0% |
| | DIVERSION RATIO w | 87.0% | 91.2% | 100% | 100% |
| | INTERMEDIATE PRESSURE Pm | 10.23 [MPa] | 9.05 [MPa] | 9.15 [MPa] | 7.13 [MPa] |
| σvEC*=0.196 | C.O.P. RATIO | 109.0% | 105.5% | 109.2% | 113.6% |

FIG. 10

| Wmax≒ 50% | | | | | |
|---|---|---|---|---|---|
| VOLUME RATIO AT COMPLETION OF SUB DISCHARGE u:0.232 | | RATED COOLING | INTERMEDIATE COOLING | RATED HEATING | INTERMEDIATE HEATING |
| σvEC | | 0.170 | 0.176 | 0.238 | 0.196 |
| MATCHING WITH RATED COOLING | PRE- EXPANSION RATIO y | 0% | 0% | 0% | 0% |
| | BYPASS RATIO x | 0% | 0% | 35.8% | 10.1% |
| | DIVERSION RATIO w | 58.7% | 67.4% | 55.3% | 63.6% |
| | INTERMEDIATE PRESSURE Pm | 9.66 [MPa] | 8.60 [MPa] | 9.06 [MPa] | 7.24 [MPa] |
| σvEC*=0.280 | C.O.P. RATIO | 111.7% | 112.1% | 105.2% | 106.3% |

| VOLUME RATIO AT COMPLETION OF SUB DISCHARGE u:0.231 | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH INTERMEDIATE COOLING | PRE- EXPANSION RATIO y | 0% | 0% | 0% | 0% |
| | BYPASS RATIO x | 9.7% | 0% | 42.1% | 18.7% |
| | DIVERSION RATIO w | 58.6% | 67.7% | 55.1% | 63.5% |
| | INTERMEDIATE PRESSURE Pm | 9.82 [MPa] | 8.59 [MPa] | 9.22 [MPa] | 7.36 [MPa] |
| σvEC*=0.256 | C.O.P. RATIO | 109.9% | 112.6% | 104.1% | 104.7% |

| VOLUME RATIO AT COMPLETION OF SUB DISCHARGE u:0.243 | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH RATED HEATING | PRE- EXPANSION RATIO y | 0% | 0% | 0% | 0% |
| | BYPASS RATIO x | 0% | 0% | 0% | 0% |
| | DIVERSION RATIO w | 57.4% | 65.7% | 56.3% | 64.3% |
| | INTERMEDIATE PRESSURE Pm | 9.46 [MPa] | 8.69 [MPa] | 8.16 [MPa] | 6.55 [MPa] |
| σvEC*=0.400 | C.O.P. RATIO | 112.3% | 109.4% | 112.0% | 116.9% |

| VOLUME RATIO AT COMPLETION OF SUB DISCHARGE u:0.236 | | RATED COOLING | INTERMEDIATE COOLING | RATED HEATING | INTERMEDIATE HEATING |
|---|---|---|---|---|---|
| σvEC | | 0.170 | 0.176 | 0.238 | 0.196 |
| MATCHING WITH INTERMEDIATE HEATING | PRE- EXPANSION RATIO y | 0% | 0% | 0% | 0% |
| | BYPASS RATIO x | 0.0% | 0% | 30.5% | 0% |
| | DIVERSION RATIO w | 57.4% | 66.2% | 55.7% | 64.6% |
| | INTERMEDIATE PRESSURE Pm | 9.91 [MPa] | 8.93 [MPa] | 8.75 [MPa] | 6.79 [MPa] |
| σvEC*=0.294 | C.O.P. RATIO | 108.8% | 105.8% | 107.3% | 113.0% |

REFRIGERATION CYCLE APPARATUS

TECHNICAL FIELD

The present invention relates to a refrigeration cycle apparatus configured to recover power from an expansion process.

BACKGROUND ART

For example, among a refrigeration cycle apparatus of the related art used for refrigeration or air conditioning, there is a type of apparatus that undergoes an expansion process with a positive displacement fluid machine (expansion mechanism), and uses the expansion power recovered at this time for a compression process performed in the positive displacement fluid machine (compression mechanism). A problem encountered in this refrigeration cycle apparatus of the related art is matching of the volumetric flow rate, a so-called "constraint of constant density ratio". In other words, since the ratio between a suction volume of the compression mechanism that is driven by the recovered power of the expansion mechanism and a suction volume of the expansion mechanism is fixed, when flow rates of both mechanisms are the same, the ratio of specific volumes of refrigerant at inlets of both mechanisms need to match the ratio of the suction volumes.

In the refrigeration cycle apparatus of the related art as described above, for example, an expander is designed under the condition of matching the ratio of specific volumes of refrigerant (the specific volume of refrigerant at the inlet of the expansion mechanism/specific volume of refrigerant at the inlet of the compression mechanism) with the ratio of suction volume (suction volume of the expansion mechanism/suction volume of the compression mechanism). However, when the refrigeration cycle apparatus is actually operated, a gap occurs between the ratio of specific volumes of refrigerant and the ratio of the suction volumes according to a change in condition of the actual operation. In order to match the gap of the ratio of specific volumes of refrigerant and the ratio of suction volumes from the design points, for example, a refrigeration cycle apparatus has been proposed constituted by "a refrigerant circuit in which a compressor 1 having a motor 11, an outdoor side heat exchanger 3, a expander 6, and an indoor side heat exchanger 8 are connected with pipes. Also, a pre-expansion valve 5 is provided on an inflow side of the expander 6. A bypass circuit which bypasses the pre-expansion valve 5 and the expander 6 is provided in parallel with the pre-expansion valve 5 and the expander 6, and a control valve 7 is provided in the bypass circuit. A drive shaft of the expander 6 and a drive shaft of the compressor 1 are coupled, and the compressor 1 uses power recovered by the expander 6 to drive" (for example, see PTL 1).

The refrigeration cycle apparatus of the related art described above (for example, see PTL 1) causes a predetermined amount of refrigerant to flow in the bypass circuit when (specific volume of refrigerant at the inlet of the expansion mechanism/specific volume of refrigerant at the inlet of the compression mechanism)>(suction volume of the expansion mechanism/suction volume of the compression mechanism). At this time, flow rate of the refrigerant to be circulated through the bypass circuit (opening-degree of the control valve provided in the bypass circuit) is controlled based on the bypass flow ratio that is determined by determining the optimum high pressure that maximizes the C.O.P. Also, when (specific volume of refrigerant at the inlet of the expansion mechanism/specific volume of refrigerant at the inlet of the compression mechanism)<(suction volume of the expansion mechanism/suction volume of the compression mechanism), the pre-expansion valve provided on the suction side of the expansion mechanism reduces the pressure to a predetermined pressure and expands the refrigerant flowing into the expansion mechanism.

CITATION LIST

Patent Literature

PTL 1: Japanese Unexamined Patent Application Publication No. 2004-150750 (Paragraph 0008, FIG. 1)

SUMMARY OF INVENTION

Technical Problem

However, pre-expansion to match the volumetric flow rate when (specific volume of refrigerant at the inlet of the expansion mechanism/specific volume of refrigerant at the inlet of the compression mechanism)<(suction volume of the expansion mechanism/suction volume of the compression mechanism) is in many cases performed to a liquid-phase refrigerant or a refrigerant in the supercritical region on the liquid phase side. Therefore, there are problems in that the change in specific volume is comparatively small to the degree of drop in pressure and almost all of the high-low pressure difference is pre-expansioned, or in that the matching of the volumetric flow rate cannot be achieved in many cases even when pre-expansion is performed until there is no more power to be recovered.

The invention was made to solve the above-described problems, and an object of the invention is to obtain a refrigeration cycle apparatus which is capable of matching the volumetric flow rate without performing pre-expansion even when (specific volume of a refrigerant at the inlet of the expansion mechanism/specific volume of refrigerant at the inlet of a compression mechanism)<(suction volume of the expansion mechanism/suction volume of the compression mechanism).

Solution to Problem

The refrigeration cycle apparatus according to the invention includes a refrigeration circuit having a compression unit, a gas cooler, an expansion mechanism, and an evaporator interconnected with pipes; and a sub-compression mechanism driven by power recovered by the expansion mechanism, in which a suction side of the sub-compression mechanism is connected to a compression process of the compression unit, a discharge side of the sub-compression mechanism is connected to an inlet side of the gas cooler, and flow rate of refrigerant flowing into the sub-compression mechanism is controlled.

Advantageous Effects of Invention

In the invention, matching of volumetric flow rate is performed on a compression process side. Therefore, even when (specific volume of refrigerant at the inlet of the expansion mechanism/specific volume of refrigerant at the inlet of the compression mechanism)<(suction volume of the expansion mechanism/suction volume of the compression mechanism), matching of the volumetric flow rate can be achieved without performing pre-expansion.

BRIEF DESCRIPTION OF DRAWINGS

FIG. 5 is an explanatory table showing a rate of pre-expansion y and a ratio of bypass x and the like in a case where a flow-rate matching is achieved by the flow-rate matching method of the related art.

FIG. 6 is an explanatory table showing a rate of pre-expansion y and a ratio of bypass x and the like in a case where the flow-rate matching is achieved by the flow-rate matching method according to Embodiment 1.

FIG. 10 is an explanatory table showing a rate of pre-expansion y and a ratio of bypass x and the like in a case where a flow-rate matching is achieved by a flow-rate matching method according to Embodiment 3.

DESCRIPTION OF EMBODIMENTS

The refrigeration cycle apparatus according to the invention will be described below.

In the Embodiments below, the same or similar functions and configurations will be described using the same numerals. Also, flow rate in the Embodiments below represents the volumetric flow rate. The configurations shown in the following Embodiments are only exemplifications and do not limit the invention.

Embodiment 1

Figure 1:
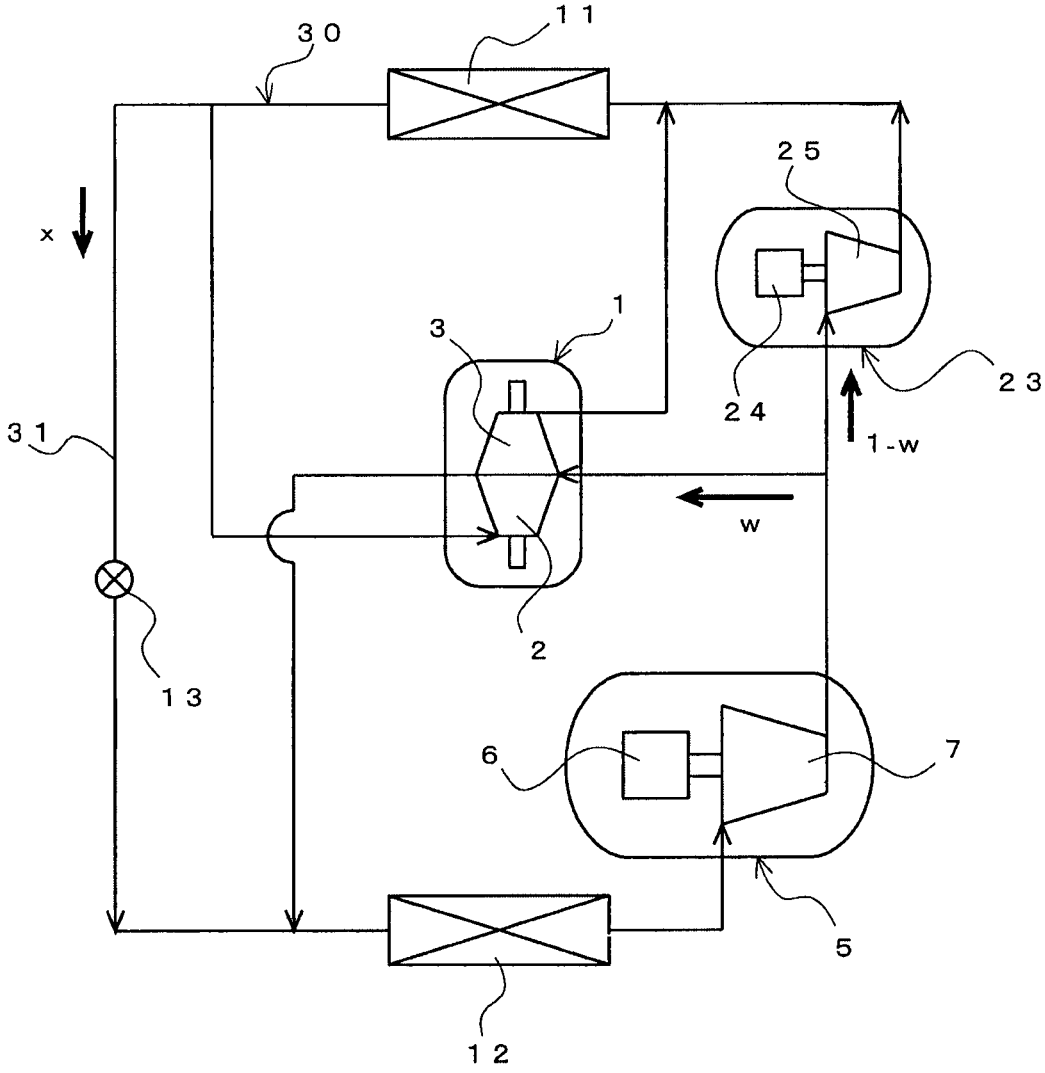
FIG. 1 is a block diagram schematically showing a refrigerant circuit of the refrigeration cycle apparatus according to Embodiment 1.

FIG. 1 is a block diagram schematically showing a refrigerant circuit of a refrigeration cycle apparatus according to Embodiment 1.

The refrigeration cycle apparatus according to Embodiment 1 includes a main compressor 5, a second compressor 23, a gas cooler 11, an expander 1, an evaporator 12, and the like. The main compressor 5 includes a main compression mechanism 7 and a motor 6 or the like which drives the main compression mechanism 7. The second compressor 23 includes a second compression mechanism 25 and a motor 24 or the like which drives the second compression mechanism 25. Also, the expander 1 includes an expansion mechanism 2, a sub-compression mechanism 3, and the like. The sub-compression mechanism 3 is connected to the expansion mechanism 2 by, for example, a shaft or the like, and is driven by power recovered by the expansion mechanism 2 when a refrigerant is decompressed by the expansion mechanism 2. Here, the main compressor 5 and the second compressor 23 correspond to the compression unit of the invention.

A refrigeration circuit 30 of this refrigeration cycle apparatus includes the main compression mechanism 7 of the main compressor 5, the second compression mechanism 25 of the second compressor 23, the gas cooler 11, the expansion mechanism 2 of the expander 1, and the evaporator 12 interconnected by refrigerant pipes in sequence. Also, the sub-compression mechanism 3 of the expander 1 is connected at its suction side to the refrigerant pipe which connects the main compression mechanism 7 and the second compression mechanism 25 and is connected at its discharge side to the refrigerant pipe which connects the second compression mechanism 25 and the gas cooler 11. In other words, the sub-compression mechanism 3 of the expander 1 is connected at its suction side to a compression process of the compression unit and at its discharge side to an inlet side of the gas cooler.

The refrigeration circuit 30 is provided with a bypass circuit 31 in parallel with the expansion mechanism 2 of the expander 1. The bypass circuit 31 is provided with an expansion valve 13.

In Embodiment 1, as a refrigerant flowing in the refrigeration circuit 30, for example, $CO_2$ refrigerant is assumed.

(Description of Operation)

Subsequently, the operation of the refrigeration cycle apparatus according to Embodiment 1 will be described. The below will be described assuming that, total flow of refrigerant flowing in the refrigeration circuit 30 is 1, and out of this amount, a diversion ratio of the refrigerant flowing in the sub-compression mechanism 3 is w. The refrigerant sucked into the main compression mechanism 7 is compressed by a driving force of the motor 6. Out of the sucked refrigerant, an amount corresponding to the diversion ratio w flows into the sub-compression mechanism 3, and an amount corresponding to (1−w) flows into the second compression mechanism 25 driven by the motor 24. The refrigerant of the amount corresponding to the diversion ratio w that has flowed into the sub-compression mechanism 3 is further compressed by power recovered by the expansion mechanism 2. On the other hand, the refrigerant of the amount corresponding to (1−w) that has flowed into the second compression mechanism 25 is further compressed by power obtained from the motor 24. Refrigerant compressed by the sub-compression mechanism 3 and the second compression mechanism 25 are merged on the inlet side of the gas cooler 11, and flows into the gas cooler 11.

The refrigerant that has flowed into the gas cooler 11 is cooled by, for example, outside air, and flows into the expansion mechanism 2. Then, the refrigerant that has flowed into the expansion mechanism 2 is decompressed by the expansion mechanism 2 and flows into the evaporator 12. In the expansion and decompression process in the expansion mechanism 2, power which drives the sub-compression mechanism 3 is generated.

The refrigerant that has flowed into the evaporator 12 is heated by, for example, air in a refrigeration space or an air-conditioning space (cools air in the refrigeration space or the air-conditioning space) and is sucked into the main compressor 5 again.

In other words, the refrigerant sucked into the main compression mechanism 7 is compressed in two stages by the main compression mechanism 7 (the main compressor 5) and the second compression mechanism 25 (the second compressor 23) by supplying electric power to the motor 6 and the motor 24. Also, the sub-compression mechanism 3 is driven by power generated when the refrigerant that has come out from the gas cooler 11 is expanded and decompressed in the expansion mechanism 2. It is recommended that the second compressor 23 is operated at a rotation speed that is in accordance with the specific volume of refrigerant discharged from the main compressor 5 for an initial period of operation of the refrigeration cycle apparatus so that a degree of pressure increase of refrigerant in the second compressor 23 is minimized. Accordingly, the sub-compression mechanism 3 obtains, from the expansion mechanism 2, recovered power to drive the refrigerant of an amount corresponding to the diversion ratio w and starts to increase the pressure of the refrigerant that has flowed into the sub-compression mechanism.

When a refrigerant pressure at the inlet of the sub-compression mechanism 3 at this time (=discharge pressure of the main compressor 5) is Pm, and the refrigerant pressure at an outlet of the sub-compression mechanism 3 (=refrigerant pressure at the inlet of the gas cooler 11) is Ph, the diversion ratio w is determined by the rotation speed of the expander 1 and Pm. In other words, the diversion ratio w can be controlled by the rotation speed of the second compressor 23. The degree of the pressure increase Ph-Pm in the sub-compression mechanism 3 is determined by the flow rate of the refrigerant of an amount corresponding to w and the recovered power in the expansion mechanism 2.

It is only when under the design condition of the expander 1, that the sub-compression mechanism 3 can compress the total amount of refrigerant flowing in the refrigeration circuit 30 (when w is 1). Therefore, when the operating condition of the refrigeration cycle apparatus do not comply with the design condition of the expander 1, the refrigerant of an amount corresponding to (1−w) is increased in pressure in the second compressor 23. In other words, matching of flow rate is achieved with the second compressor 23 shouldering the margin amounting to the change between the design points of the expander 1 and the actual operating condition of the refrigeration cycle apparatus.

Figures 2, 3:
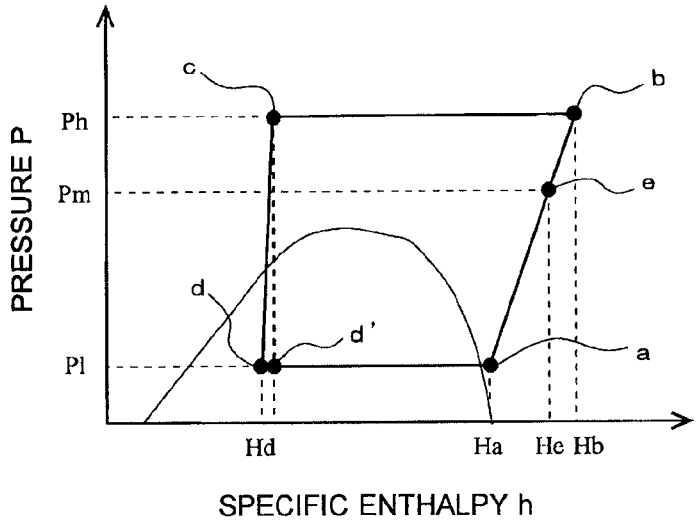
FIG. 2 is a Mollier chart showing a change of state of a refrigerant while the refrigeration cycle apparatus according to Embodiment 1 is in operation.
FIG. 3 is a condition table showing representative operating conditions of the refrigeration cycle apparatus.

FIG. 2 is a Mollier chart showing a change of state of the refrigerant when the refrigeration cycle apparatus according to Embodiment 1 of the invention is in operation. In this chart, the vertical axis represents the refrigerant pressure, and the lateral axis represents the specific enthalpy.

The part b to c in FIG. 2 is a cooling process in the gas cooler 11 shown in FIG. 1. In Embodiment 1, CO2 is assumed as the refrigerant, and thus the pressure Ph exceeds the critical pressure.

The part c to d in FIG. 2 corresponds to the expansion and decompression process in the expander 1 (expansion mechanism 2) in FIG. 1. In FIG. 2, an expansion and decompression process with an expansion device such as the expansion valve that does not recover power is indicated by c to d'. When pressure of refrigerant that has flowed out from the gas cooler 11 is reduced with the expansion device such as the expansion valve that does not recover power, the refrigerant is expanded and decompressed with a constant specific enthalpy (c to d'). On the other hand, when the refrigerant that has flowed out from the gas cooler 11 is expanded and decompressed while generating expansion power in the expansion mechanism 2, the procedure follows a process of c to d. The difference in specific enthalpy d'−d at the time of expansion and pressure reduction is energy recovered as power. After the refrigerant is compressed from a to e by the main compressor 5, the recovered energy is used in the sub-compression mechanism 3, and the refrigerant of an amount corresponding to the ratio of flow w is compressed from e to b. The compression of the refrigerant of an amount corresponding to the ratio of flow (1−W) performed by the second compressor 23 is also denoted by e to b in the Mollier chart.

At this time, a value corresponding to (enthalpy difference ha−hd)×(flow rate 1) is the refrigeration capacity of the refrigeration cycle apparatus. Also, an electrical input of a value corresponding to (enthalpy difference he−ha)×(flow rate 1)+(enthalpy difference hb−he)×(flow rate 1-w) is consumed by the motor 6 and the motor 24 of the main compressor 5 and the second compressor 23. The ratio between the refrigeration capacity and the electrical input is so-called a cycle C.O.P.

In the refrigeration cycle apparatus using the expansion device such as the expansion valve that does not recover power, the electrical input at the time of compressing the refrigerant from a low pressure Pl to a high pressure Ph is (enthalpy difference hb−ha)×(flow rate 1). Also, the refrigeration capacity is (enthalpy difference ha−hd')×(flow rate 1).

When comparing the refrigeration cycle apparatus according to Embodiment 1 and the refrigeration cycle apparatus which does not perform power recovery, it is found that power recovery contributes to an improvement of C.O.P. in both electrical input and refrigeration capacity.

As described above, the maximum value of the diversion ratio w is 1. At this time, the entirety of the refrigerant discharged from the main compressor 5 is additionally compressed in the sub-compression mechanism 3 of the expander 1. Therefore, when the diversion ratio w is the maximum value 1, the second compressor 23, without operating, may only need to work as a check valve. The operation reducing the diversion ratio w from 1 by operating the second compressor 23 (the operation reducing the flow rate of the refrigerant at the inlet of the sub-compression mechanism 3) is equivalent to the flow-rate matching of the refrigeration cycle apparatus of the related art as described in PTL 1, where pre-expansion is performed (the operation to increase the flow rate at the inlet of the expansion mechanism by performing pre-expansion before the inlet of the expansion mechanism) when (specific volume of refrigerant at the inlet of the expansion mechanism/specific volume of refrigerant at the inlet of the compression mechanism)<(suction volume of the expansion mechanism/suction volume of the compression mechanism).

Therefore, as shown in FIG. 1, the refrigeration cycle apparatus according to Embodiment 1 does not need the expansion valve that performs pre-expansion. In other words, the matching of flow rate can be performed using the diversion ratio w (the ratio of the flow rate of the refrigerant to be increased in pressure in the sub-compression mechanism 3 with respect to total flow of refrigerant flowing thorough the refrigeration circuit 30) and the ratio of bypass×(the ratio of the flow rate of the refrigerant caused to bypass the expansion mechanism 2 with respect to total flow of refrigerant flowing through the refrigeration circuit 30).

Here, in order to describe the advantages of a flow-rate matching method of Embodiment 1, the refrigeration cycle apparatus according to Embodiment 1 is compared with the refrigeration cycle apparatus in which the flow-rate matching method of the related art is employed. Here, under four representative conditions shown in FIG. 3, the refrigeration cycle apparatus according to Embodiment 1 is compared with the refrigeration cycle apparatus in which the flow-rate matching method of the related art is employed.

FIG. 3 is a condition table showing representative operating conditions of the refrigeration cycle apparatus.

Figure 4:
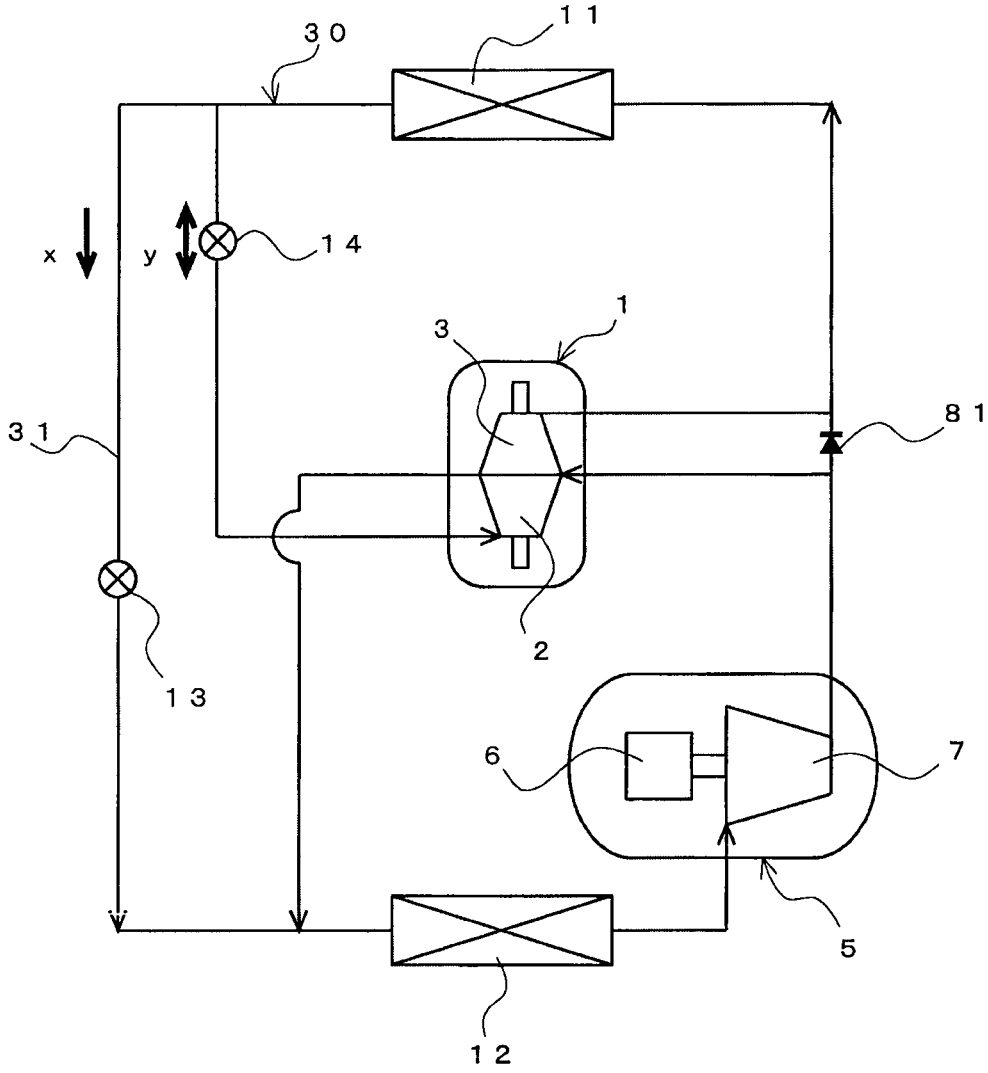
FIG. 4 is a block diagram schematically showing a refrigerant circuit of the refrigeration cycle apparatus using a flow-rate matching method of the related art.

FIG. 4 is a block diagram schematically showing a refrigerant circuit of the refrigeration cycle apparatus using the flow-rate matching method of the related art.

The refrigeration cycle apparatus in which the flow-rate matching method of the related art is employed shown in FIG. 4 is provided with a check valve 81 in a position where the second compressor 23 in the refrigeration cycle apparatus in Embodiment 1 is positioned. In other words, the refrigeration cycle apparatus in which the flow-rate matching method of the related art is employed shown in FIG. 4 is configured so that all the refrigerant discharged from the main compression mechanism 7 (compression unit) of the main compressor 5 flows into the sub-compression mechanism 3 of the expander 1. Also, the refrigeration cycle apparatus in which the flow-rate matching method of the related art is employed shown in FIG. 4 is provided with a pre-expansion valve 14 between the gas cooler 11 and the expansion mechanism 2 of the expander 1.

FIG. 3 shows the representative operating conditions of the refrigeration cycle apparatus, namely, a rated cooling condition, an intermediate cooling condition, a rated heating condition, and an intermediate heating condition. More specifically, the refrigerant pressure and the refrigerant temperature at the inlet of the expansion mechanism 2, the refrigerant pressure and the refrigerant temperature at the outlet of the expansion mechanism 2, the pressure and the temperature of the refrigerant to be sucked by the main compression mechanism 7 of the main compressor 5, the pressure and the temperature of the refrigerant to be discharged by the sub-compression mechanism 3 of the expander 1 in each of the operating conditions are shown.

Also, FIG. 3 shows (suction volume of the expansion mechanism 2/suction volume of the sub-compression mechanism 3) in which both the ratio of bypass x and the pre-expansion ratio y become zero as shown in FIG. 4, that is, σvEC, which is (specific volume of refrigerant at the inlet of the expansion mechanism 2/specific volume at the inlet of the sub-compression mechanism 3) determined by the operating condition. The cycle C.O.P at this time is C.O.P.th. Here, the pre-expansion ratio y is a ratio of a degree of pressure reduction (the total high-low pressure difference) of the refrigerant in the expansion and decompression process in the refrigeration circuit 30, and the degree of the pressure reduction at the time of pre-expansion of the refrigerant in the pre-expansion valve 14.

When (suction volume of the expansion mechanism 2/suction volume of the sub-compression mechanism 3)=σvEC* is set to one of the operation condition shown in FIG. 3 while satisfying (specific volume of refrigerant at the inlet of the expansion mechanism 2/specific volume of refrigerant at the inlet of the sub-compression mechanism 3)=(suction volume of the expansion mechanism 2/suction volume of the sub-compression mechanism 3) and when flow-rate matching is performed with the pre-expansion ratio y and the ratio of bypass x to the other three operation conditions, it will be as shown in FIG. 5.

FIG. 5 shows, under the condition in which σvEC is set to (specific volume of refrigerant at the inlet of the expansion mechanism 2/specific volume of refrigerant at the inlet of the sub-compression mechanism 3), the required pre-expansion ratio y, ratio of bypass x, intermediate pressure Pm which is the refrigerant pressure at the inlet of the sub-compression mechanism 3, and the C.O.P at this time, to match the flow rate using the expander 1 with the σvEC* set to (suction volume of the expansion mechanism 2/suction volume of the sub-compression mechanism 3). The C.O.P is shown as a ratio with respect to the C.O.P.th in FIG. 3.

As a matter of course, if σvEC*=σvEC, neither bypassing nor pre-expansion is necessary. If σvEC*<σvEC, bypassing is performed to match the flow rate. If σvEC*>σvEC, pre-expansion is performed to match the flow rate. However, if σvEC* is excessively larger than σvEC, a situation will occur in which matching of the flow rate cannot be achieved even though pre-expansion is performed to the maximum, or even when matching is achieved, the C.O.P ratio falls below 100% and the advantage of improvement of performance with the recovery of expansion power cannot be obtained. For example, in FIG. 5, the cooling condition, in which σvEC* is set to meet the heating condition, corresponds to the condition described above. It is understood that the flow-rate matching method of the related art is not suitable when the expander 1 designed for heating is used under the cooling condition.

On the other hand, in the refrigeration cycle apparatus (FIG. 1) according to Embodiment 1, When (suction volume of the expansion mechanism 2/suction volume of the sub-compression mechanism 3)=vvEC* is set to one of the operation condition shown in FIG. 3 while satisfying (specific volume of refrigerant at the inlet of the expansion mechanism 2/specific volume of refrigerant at the inlet of the sub-compression mechanism 3)=(suction volume of the expansion mechanism 2/suction volume of the sub-compression mechanism 3) and when flow-rate matching is performed with the pre-expansion ratio y and the ratio of bypass x to the other three operation conditions, it will be as shown in FIG. 6. FIG. 6 shows, under the condition in which σvEC is set to (specific volume of refrigerant at the inlet of the expansion mechanism 2/specific volume of refrigerant at the inlet of the sub-compression mechanism 3), the required pre-expansion ratio y, ratio of bypass x, diversion ratio w, intermediate pressure Pm which is the refrigerant pressure at the inlet of the sub-compression mechanism 3, and the C.O.P at this time, to match the flow rate using the expander 1 with the σvEC* set to (suction volume of the expansion mechanism 2/suction volume of the sub-compression mechanism 3). The C.O.P is shown as a ratio with respect to the C.O.P.th in FIG. 3.

When diversion ratio w=100%, total flow of refrigerant discharged from the main compression mechanism 7 of the main compressor 5 (total flow of refrigerant flowing in the refrigeration circuit 30) is increased in pressure by the sub-compression mechanism 3, and the second compressor 23 is not operated. Therefore, the pre-expansion ratio y, the ratio of bypass x, the diversion ratio w, the intermediate pressure Pm, and the C.O.P when the diversion ratio w=100% are the same as those of the refrigeration cycle apparatus in which the flow-rate matching method of the related art is employed (FIG. 5).

However, when diversion ratio w<100%, by diverting instead of performing pre-expansion of the flow-rate matching method of the related art, matching of the flow rate is achieved without suffering from the lowering of the C.O.P under the cooling condition even when σvEC* is set to heating.

The reason why there are differences in the breadth of the operating range (the breadth of the flow-rate matching range) and the C.O.P as described above between the refrigeration cycle apparatus in which the flow-rate matching method of the related art is employed and the refrigeration cycle apparatus according to Embodiment 1 is as follows.

Change of state of the refrigerant when the refrigeration cycle apparatus using the flow-rate matching method of the related art is in operation will be described using the Mollier chart in FIG. 2. The total amount of refrigerant compressed from a to e in the main compressor 5 is sucked into the sub-compression mechanism 3 and is compressed from e to b. This refrigerant is cooled from b to c in the gas cooler 11.

The refrigerant cooled in the gas cooler 11 follows the expansion and decompression process c to d or c to d' according to the flow-rate matching condition (the pre-expansion ratio y, ratio of bypass x).

When bypassing, the refrigerant by an amount corresponding to the flow rate (1-x) to be expanded and decompressed in the expansion mechanism 2 of the expander 1 follows an isentropic expansion process such as from c to d. The refrigerant of an amount corresponding to the flow rate x that has bypassed the expander 1 (flowing through the bypass circuit 31) is decompressed by the expansion valve 13, and hence follows an isenthalpic expansion process such as c to d'.

When performing pre-expansion, the refrigerant cooled by the gas cooler 11 is subject to the isenthalpic expansion from c to d' by an amount corresponding to the pre-expansion ratio y by the pre-expansion valve 14 and is then subject to the isentropic expansion by the expansion mechanism 2.

The expansion power recovered by the expansion mechanism 2 in the expansion and decompression process is, when bypassing, an amount corresponding to the flow rate (1−x) of the enthalpy difference d'−d. Also, when performing pre-expansion, it is an enthalpy difference of the isentropic expansion from the pressure Pl+(Ph−Pl)·(1−y) to Pl. In either case, the expansion power recovered by the expansion mechanism 2 is reduced in comparison with the case where the total volume of the refrigerant is subject to the isentropic expansion without bypassing or pre-expansion. Since the sub-compression mechanism 3 can be driven with the reduced recovered power by bypassing or pre-expansion, the intermediate pressure PM which is the pressure at point e increases, and hence the degree of pressure increase from e to b in the sub-compression mechanism 3 reduces. Since the specific volume of refrigerant at point e changes with the increase in the intermediate pressure Pm, the ratio of bypass x and the pre-expansion ratio y further changes so as to match therewith. In this manner, the expansion mechanism 2 and the sub-compression mechanism 3 are subject to matching of power and ratio of suction volume ratio.

In other words, in the flow-rate matching method of the related art, bypassing and pre-expansion are performed so that (flow rate at the inlet of the expansion mechanism 2/flow rate at the inlet of the sub-compression mechanism 3)=(suction volume of the expansion mechanism 2/suction volume of the sub-compression mechanism 3). The intermediate pressure is determined so as to match the reduced recovered power by performing the bypassing or pre-expansion. As a result, pressure increasing work of the main compressor 5 increases. In other words, in the flow-rate matching method of the related art, control of the flow rate is performed mainly on the expansion and decompression process side.

On the other hand, in the flow-rate matching method in Embodiment 1, control of flow rate is performed with the diversion ratio w (the ratio of the compression process from the intermediate pressure Pm to the high pressure Ph performed by the sub-compression mechanism 3 of the expander 1 and the second compression mechanism 25 of the second compressor 23). In other words, in the flow-rate matching method in Embodiment 1, control of flow rate is performed on the compression process side.

Because of this difference, the refrigeration cycle apparatus according to Embodiment 1 is capable of matching the volumetric flow rate without performing pre-expansion even when (specific volume of refrigerant at the inlet of the expansion mechanism/specific volume of refrigerant at the inlet of the compression mechanism)<(suction volume of the expansion mechanism/suction volume of the compression mechanism) in contrast to the refrigeration cycle apparatus in which the flow-rate matching method of the related art is employed. Therefore, matching of the volumetric flow rate can be performed even under conditions in which the refrigeration cycle apparatus of the related art performing pre-expansion could not perform the matching of the volumetric flow rate. Accordingly, flow-rate matching in a wide range of operating conditions is enabled. Also, the C.O.P at that time improves.

The advantage is apparent in an air conditioning application using $CO_2$ refrigerant having a large high-low pressure difference, in which the high-pressure side becomes supercritical.

Although the compression unit is made up of two compressors (the main compressor 5 and the second compressor 23) in the refrigeration cycle apparatus according to Embodiment 1, the number of compressors which constitute the compression unit is arbitrary. Also, a midsection of the main compression mechanism 7 of the main compressor 5 (the compression process of the main compression mechanism 7) and the suction-side of the sub-compression mechanism 3 of the expander 1 may be connected.

Furthermore, although the bypass circuit 31 is provided in the refrigeration cycle apparatus according to Embodiment 1, the bypass circuit 31 is not a configuration which is essential. σvEC* may be set to operating conditions which do not require bypassing (the rated heating condition shown in FIG. 3 and FIG. 6, for example).

Embodiment 2

In Embodiment 1, the diversion ratio w is controlled by the rotation speed of the second compressor 23. The invention is not limited thereto, and the diversion ratio w can be controlled by other methods. In Embodiment 2, items not specifically described are the same as those in Embodiment 1.

Figure 7:
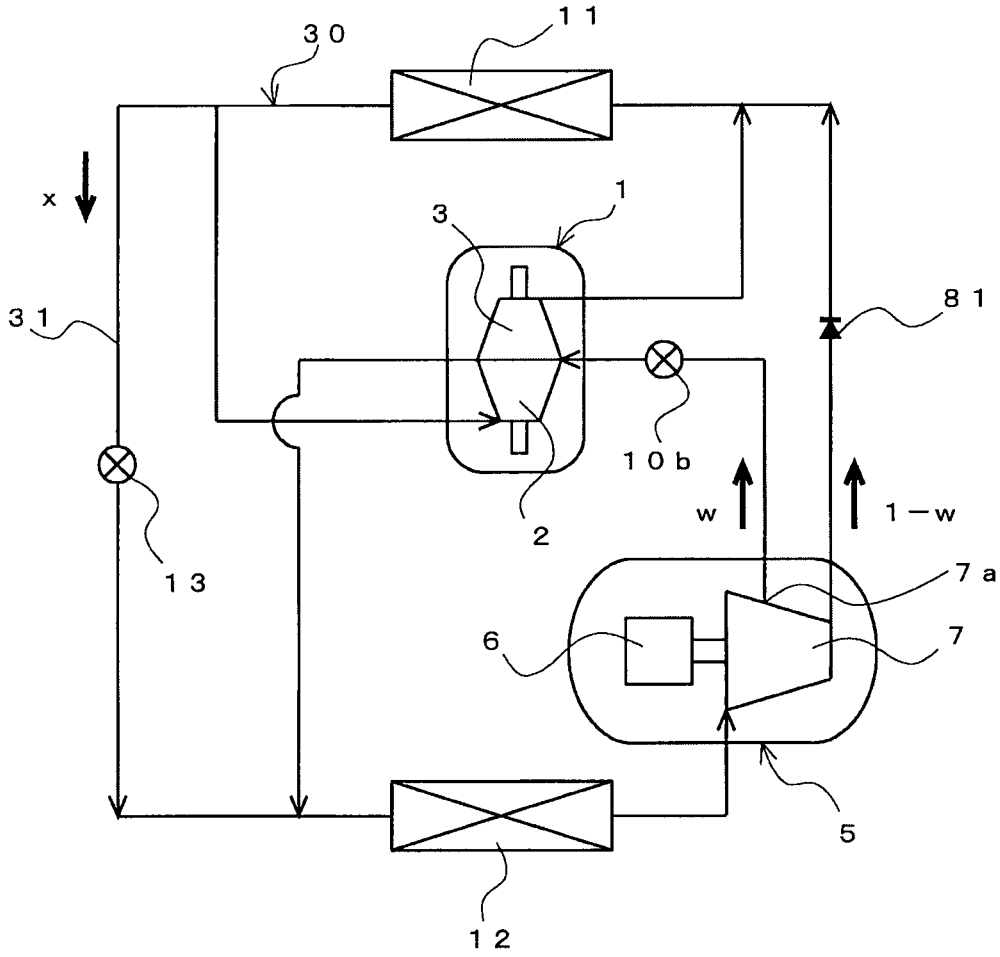
FIG. 7 is a block diagram schematically showing a refrigerant circuit of the refrigeration cycle apparatus according to Embodiment 2.

FIG. 7 is a block diagram schematically showing a refrigerant circuit of a refrigeration cycle apparatus according to Embodiment 2. The refrigeration cycle apparatus according to Embodiment 2 is provided with a check valve 81 at the position of the second compressor 23 in the refrigeration cycle apparatus (FIG. 1) in Embodiment 1. A main compressor 5 has a multi-port structure having a sub-discharge port 7*a* partway of a compression process. An outlet space of an original discharge port and an outlet space of the sub-discharge port 7*a* partway are separated from each other. Then, a suction side of a sub-compression mechanism 3 of an expander 1 is connected to the sub-discharge port 7*a* (the compression process of a main compression mechanism 7). Provided between the suction side of the sub-compression mechanism 3 and the sub-discharge port 7*a* is a variable expansion device 10*b* serving as volumetric flow rate control means.

In other words, the refrigeration cycle apparatus according to Embodiment 2 is configured to perform the diversion using the sub-discharge port 7*a* provided in the compression process of the main compression mechanism 7 of the main compressor 5 instead of performing the diversion based on allocation between the sub-compression mechanism and the second compressor as in the refrigeration cycle apparatus in Embodiment 1.

The position of installation of the check valve 81 does not necessarily have to be a refrigerant pipe between the main compressor 5 and a gas cooler 11. For example, if a discharge valve which blocks the reverse flow when a reverse pressure is applied is provided at an original discharge port of the main compression mechanism 7 of the main compressor 5, the check valve 81 does not necessarily have to be provided.

(Description of Operation)

Subsequently, the operation of the refrigeration cycle apparatus according to Embodiment 1 will be described.

When electric power is supplied to a motor 6, the sucked refrigerant is compressed in the main compression mechanism 7. The refrigerant discharged from the main compression mechanism 7 flows into the gas cooler 11 via the check valve 81. The refrigerant that has flowed into the gas cooler 11 is cooled by, for example, outside air, and flows into an expansion mechanism 2 or an expansion valve 13. Then, the refrigerant that has flowed into the expansion mechanism 2 or the expansion valve 13 is decompressed by resistance thereof, and flows into an evaporator 12. In the expansion and decompression process in the expansion mechanism 2, power which drives the sub-compression mechanism 3 is generated. The refrigerant that has flowed into the evaporator 12 is heated by air in the refrigeration space or the air-conditioning space (cools air in the refrigeration space or the air-conditioning space) and is sucked into the main compressor 5 again.

For example, when the expansion valve 13 is closed and the flow rate of the refrigerant passing through the expansion mechanism 2 is increased, the sub-compression mechanism 3 is driven by power (recovered power) generated in the expansion and decompression process. With the sub-compression mechanism 3 performing compression work by the recovered power, the suction side of the sub-compression mechanism 3 is decompressed with respect to the high-pressure, gas cooler 11 side. Accordingly, the pressure in the outlet space of the sub-discharge port 7*a* connected to the inlet side of the sub-compression mechanism 3 becomes lower in pressure than that of the outlet space of the original discharge port connected to the gas cooler 11, whereby discharge from the sub-discharge port 7*a* is performed.

A maximum value wmax of the diversion ratio w, which is a ratio of the flow rate of the refrigerant discharged from the sub-discharge port 7*a* with respect to total flow of refrigerant discharged from the main compression mechanism 7, is determined depending on the position where the sub-discharge port 7*a* is provided. Therefore, the refrigerant cannot be discharged from the sub-discharge port in a ratio equal to or higher than wmax. When the pressure of a compression chamber of the main compression mechanism 7 is higher than the pressure of the outlet space of the sub-discharge port 7*a*, a sub-discharge valve provided on the discharge side of the sub-discharge port 7*a* opens. Then, the change of volume in the compression chamber of the main compression mechanism 7 increases the pressure, and the refrigerant in the compression chamber of the main compression mechanism 7 is discharged toward the outlet space of the sub-discharge port 7*a*. The remaining refrigerant which has not been discharged to the outlet space of the sub-discharge port 7*a* at the time when an opening of the sub-discharge port 7*a* is ended is continually compressed in the compression chamber of the main compression mechanism 7. Consequently, a portion corresponding to the diversion ratio w is additionally compressed by the sub-compression mechanism 3 after having discharged from the sub-discharge port 7*a*, and an amount corresponding to (1−w) is continuously compressed in the main compression mechanism 7 after the sub-discharge port 7*a* is closed.

The different point of the refrigeration cycle apparatus in Embodiment 2 from the refrigeration cycle apparatus in Embodiment 1 is the compressor (more specifically, the compression mechanism of the compressor) that is in charge of increase in pressure of the refrigerant by the amount corresponding to (1−w) after the diversion. The refrigeration cycle apparatus in Embodiment 1 compresses the refrigerant with the second compression mechanism 25 of the second compressor 23 by an amount corresponding to (1−w) after the diversion, while the refrigeration cycle apparatus in Embodiment 2 compresses the refrigerant with the main compression mechanism 7 of the main compressor 5 by an amount corresponding to (1−w) after the diversion. In other words, the main compression mechanism 7 of the refrigeration cycle apparatus in Embodiment 2 performs the compression of the refrigerant at the same rotation speed, as before the opening of the sub-discharge port 7*a*, after the sub-discharge port 7*a* closes. Other points of the refrigeration cycle apparatus in Embodiment 2 and the refrigeration cycle apparatus in Embodiment 1 are the same.

Therefore, the diversion ratio w cannot be changed by the rotation speed of the main compression mechanism 7 which is in charge of increase in pressure of the refrigerant by the amount corresponding to (1−w) after the diversion, and is determined by the position of the opening of the sub-discharge port 7*a* (that is, wmax). Therefore, in order to control the diversion ratio w, volumetric flow rate control means of some type which controls the flow rate at the inlet of the sub-compression mechanism 3 is necessary. In Embodiment 2 (FIG. 7), by providing the variable expansion device 10*b* which is the volumetric flow rate control means between the suction side of the sub-compression mechanism 3 and the sub-discharge port 7*a*, the refrigeration cycle apparatus is operable even when w<wmax.

Therefore, the refrigeration cycle apparatus according to Embodiment 2 can achieve the same advantage as the refrigeration cycle apparatus according to Embodiment 1.

In Embodiment 2, although the compression unit is configured by one compressor (main compressor 5), the number of compressors which constitute the compression unit is arbitrary.

Embodiment 3

In Embodiment 2, the variable expansion device 10*b* which is a variable expansion device is provided between the suction side of the sub-compression mechanism 3 and the sub-discharge port 7*a* to control the diversion ratio w. The invention is not limited thereto, and volumetric flow rate control means other than the variable expansion device may be provided between the suction side of the sub-compression mechanism 3 and the sub-discharge port 7*a*. In Embodiment 3, items not specifically described are the same as those in Embodiment 1 and Embodiment 2.

Figure 8:
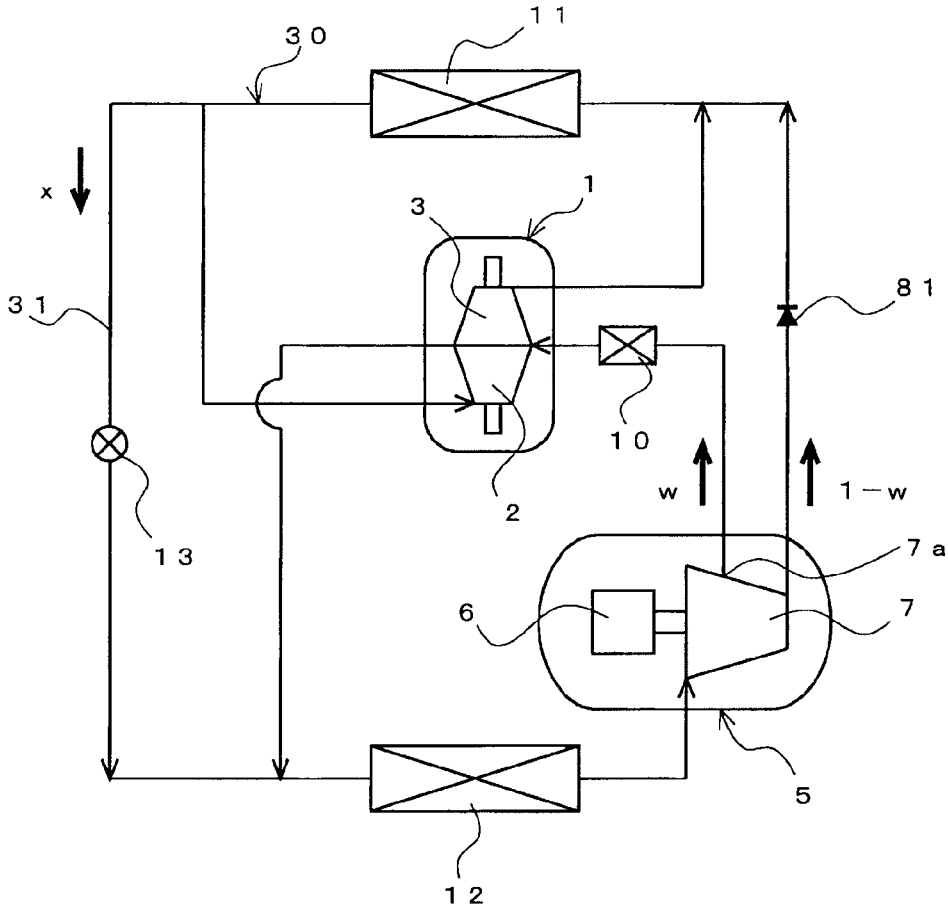
FIG. 8 is a block diagram schematically showing a refrigerant circuit of the refrigeration cycle apparatus according to Embodiment 3.

FIG. 8 is a block diagram schematically showing a refrigerant circuit of a refrigeration cycle apparatus according to Embodiment 3. The refrigeration cycle apparatus according to Embodiment 3 is provided with an intermediate cooler 10 as volumetric flow rate control means at a position of the variable expansion device 10*b* in the refrigeration cycle apparatus (FIG. 7) in Embodiment 2. In the embodiment 3, refrigerant discharged from a sub-discharge port 7*a* of a main compression mechanism 7 is cooled by the intermediate cooler 10 to control the flow rate (volumetric flow rate) of the refrigerant flowing into a sub-compression mechanism 3. Accordingly, even when w<wmax, the refrigeration cycle apparatus can be operated.

Figure 9:
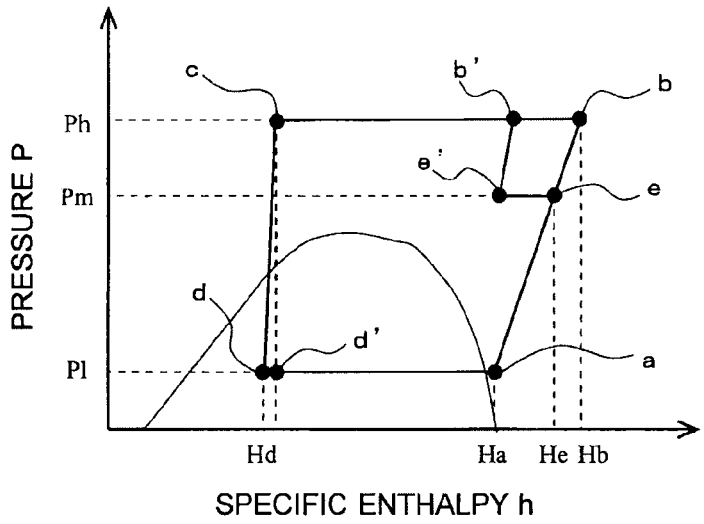
FIG. 9 is a Mollier chart showing a change of state of a refrigerant when the refrigeration cycle apparatus according to Embodiment 3 is in operation.

FIG. 9 is a Mollier chart showing a change of state of the refrigerant when the refrigeration cycle apparatus according to Embodiment 3 of the invention is in operation. The different point of FIG. 9 from FIG. 2 is that refrigerant by the amount corresponding to the diversion ratio w of refrigerant (point e) compressed to an intermediate pressure Pm is cooled to point e' by the intermediate cooler 10. In other words, the refrigerant (point e) by the amount corresponding to the diversion ratio w discharged from the sub-discharge port 7*a* of the main compression mechanism 7 is compressed to point b' by the sub-compression mechanism 3 after having been cooled to point e' by the intermediate cooler 10. On the other hand, the refrigerant (point e) by the amount corresponding to the diversion ratio (1−w) (after the sub-discharge port 7*a* is closed) which has not been discharged from the sub-discharge port 7*a* is compressed to point b by the main compression mechanism 7. Other points are the same as FIG. 2.

In the refrigeration cycle apparatus according to Embodiment 3, When (suction volume of the expansion mechanism 2/suction volume of the sub-compression mechanism 3)=σvEC* is set to one of the operation condition shown in FIG. 3 while satisfying (specific volume of refrigerant at the inlet of the expansion mechanism 2/specific volume of refrigerant at the inlet of the sub-compression mechanism 3)=(suction volume of the expansion mechanism 2/suction volume of the sub-compression mechanism 3) and when flow-rate matching is performed with the pre-expansion ratio y and the ratio of bypass x to the other three operation conditions, it will be as shown in FIG. 10. This FIG. 6 shows results of calculation when the specific volume of the main compressor 5 at completion of sub-discharge u (=volume of the compression chamber of the main compression mechanism 7 when the sub-discharge port 7*a* is closed/suction volume of the main compression mechanism 7) is fixed so that the maximum diversion ratio wmax becomes on the order of 50%. The values of specific volume at completion of sub-discharge u differ to some extent depending on the design condition (standard operating condition).

Comparing FIG. 10 (the result of calculation of the refrigeration cycle apparatus according to Embodiment 3) and FIG. 6 (the result of calculation of the refrigeration cycle apparatus according to Embodiment 1), the C.O.P ratios are substantially equivalent. When focusing attention on a case where the value σvEC* is set to the rated heating condition, the C.O.P ratio under the intermediate heating condition is better in FIG. 10 than in FIG. 6. This is because effect of the intermediate cooling in the intermediate cooler 10 has been added.

In the Mollier chart in FIG. 9, when comparing the compression process from e to b and the compression process after the intermediate cooling (from e' to b'), the inclination of the entropy line is steeper in the case from e' to b'. Accordingly, it shows that work required for compressing the same degree of pressure is smaller after the intermediate cooling. In other words, the intermediate cooling by the volumetric flow rate control means performed for controlling the diversion ratio w contributes to improvement of the cycle performance.

Therefore, the refrigeration cycle apparatus according to Embodiment 3 can achieve the same effect as the refrigeration cycle apparatus according to Embodiment 1.

Embodiment 4

The performance improvement effect owing to the intermediate cooling shown in Embodiment 3 may be introduced to the refrigeration cycle apparatus of Embodiment 1. In Embodiment 4, items not specifically described are the same as those in Embodiment 1 to Embodiment 3.

Figure 11:
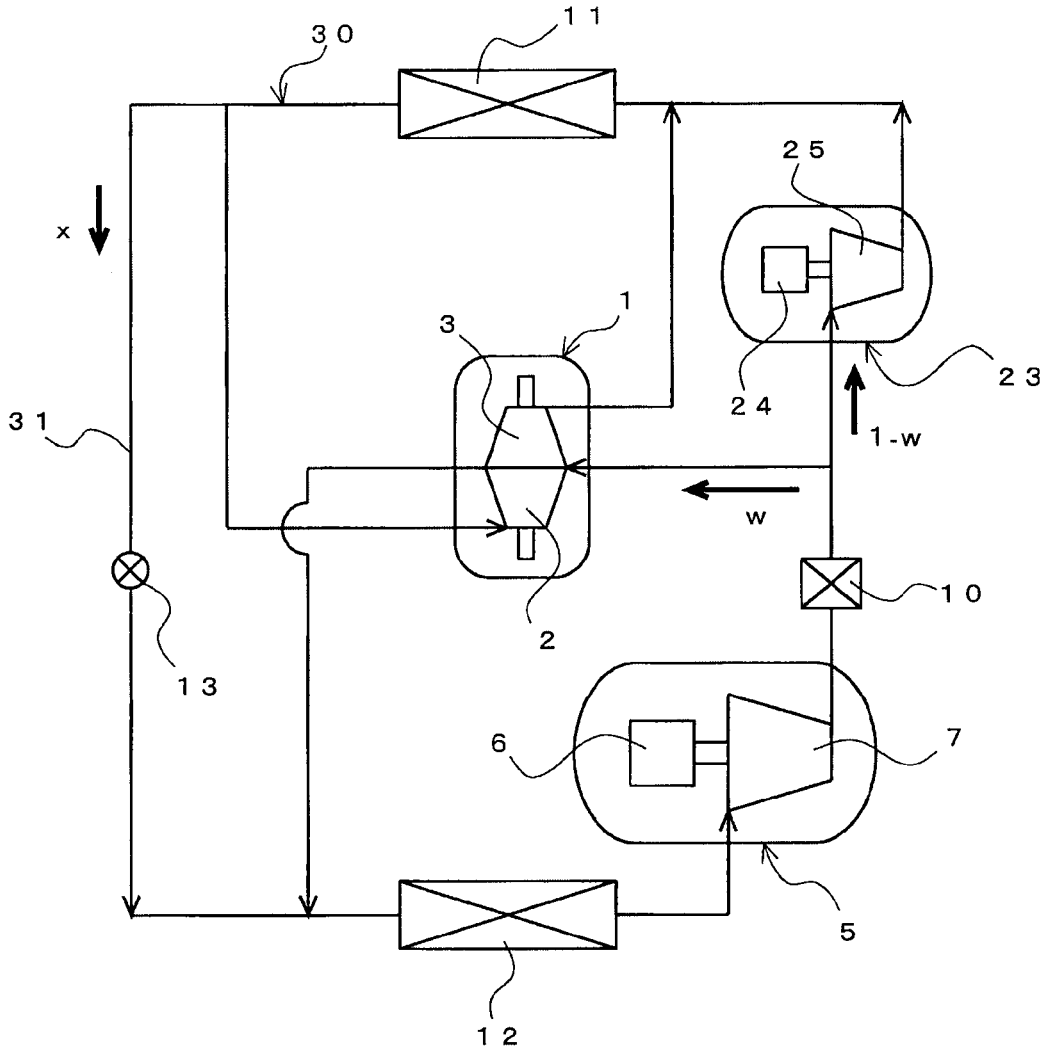
FIG. 11 is a block diagram schematically showing a refrigerant circuit of the refrigeration cycle apparatus according to Embodiment 4.

FIG. 11 is a block diagram schematically showing a refrigerant circuit of a refrigeration cycle apparatus according to Embodiment 4 of the invention. The refrigeration cycle apparatus according to Embodiment 4 is added with an intermediate cooler 10 in the refrigeration cycle apparatus (FIG. 1) of Embodiment 1. The intermediate cooler 10 is provided in a refrigerant pipe which connects a main compression mechanism 7 and a second compression mechanism 25 (a refrigerant pipe to which a sub-compression mechanism 3 is connected). More specifically the intermediate cooler 10 is provided on the upstream side of the connecting portion with the sub-compression mechanism 3 in the refrigerant pipe.

In other words, the refrigerant discharged from the main compression mechanism 7 is subject to intermediate cooling in the intermediate cooler 10 before being diverted to the sub-compression mechanism 3 and the second compression mechanism 25. In the same manner as the refrigeration cycle apparatus in Embodiment 1, the refrigeration cycle apparatus in Embodiment 4 controls the diversion ratio with the rotation speed of the second compression mechanism 25. Therefore, the intermediate cooling is provided not only for the flow-rate matching, but also for obtaining the performance improvement effect. When compared with Embodiment 3, since total flow of refrigerant flowing in the refrigeration circuit 30 is subject to intermediate cooling, the performance improvement effect is increased by an amount corresponding to the increase of the flow rate of the refrigerant following from e to e' further to b' in the Mollier chart in FIG. 9.

As described above, in each embodiment of the invention, the refrigeration circuit 30 including the compression unit, the gas cooler 11, the expansion mechanism 2, and the evaporator 12 interconnected with pipes, and the sub-compression mechanism 3 driven by power recovered by the expansion mechanism 2 are provided; the suction side of the sub-compression mechanism 3 is connected to the compression process of the compression unit, the discharge side of the sub-compression mechanism 3 is connected to the inlet side of the gas cooler 11; and the flow rate (the diversion ratio w) of the refrigerant flowing into the sub-compression mechanism 3 is controlled, and accordingly the refrigeration cycle apparatus having higher degree of efficiency than the refrigeration cycle apparatus of the related art in which the flow-rate matching is performed by the combination of pre-expansion and the expansion mechanism bypass. Also, the refrigeration cycle apparatus according to Embodiment 4 is capable of achieving matching of the volumetric flow rate without performing pre-expansion even when (specific volume of refrigerant at the inlet of the expansion mechanism/specific volume of refrigerant at the inlet of the compression mechanism)<(suction volume of the expansion mechanism/suction volume of the compression mechanism) in contrast to the refrigeration cycle apparatus in which the flow-rate matching method of the related art is employed. Therefore, matching of the volumetric flow rate can be performed even under conditions which do not allow matching of the rate of the volumetric flow to be performed in the refrigeration cycle apparatus of the related art in which pre-expansion is performed, and thus the refrigeration cycle apparatus having a wide range of operation is obtained.

When the compression unit is constituted by the main compressor 5 and the second compressor 23 and the inlet side of the sub-compression mechanism 3 is connected to the pipe which connects the main compressor 5 and the second compressor 23, the diversion ratio w can be controlled by the rotation speed of the second compressor 23.

Also, by connecting the sub-discharge port 7*a* of the main compressor 5 having the multi-port structure and the suction side of the sub-compression mechanism and by controlling the diversion ratio w by the volumetric flow rate control means such as the variable expansion device 10*b* or the intermediate cooler 10, the number of compressors driven by a power source such as a motor can be reduced. Therefore, the refrigeration cycle apparatus having higher degree of efficiency and wider range of operation than the refrigeration cycle apparatus of the related art which performs the flow-rate matching by the combination of pre-expansion and the expansion mechanism bypass can be configured at low cost. Also, the refrigeration cycle apparatus can be reduced in size.

When the intermediate cooler is provided in the refrigerant circuit of the refrigeration cycle apparatus, the refrigeration cycle apparatus having further efficiency can be obtained.

It goes without saying that the refrigeration cycle apparatus according to the invention can be employed not only to apparatus for refrigeration use or air-conditioning use, but also to various apparatus in which the refrigeration cycle apparatus is employed such as, for example, a water heater. The refrigerant to be used is not necessarily limited to $CO_2$ refrigerant.

REFERENCE SIGNS LIST

1 expander; 2 expansion mechanism; 3 sub-compression mechanism; 5 main compressor; 6 motor; 7 main compression mechanism; 7*a* sub-discharge port; 10 intermediate cooler; 10*b* variable expansion device; 11 gas cooler; 12 evaporator; 13 expansion valve; 14 pre-expansion valve; 23 second compressor; 24 motor; 25 second compression mechanism; 30 refrigeration circuit; 31 bypass circuit; 81 check valve.

The invention claimed is:

1. A refrigeration cycle apparatus comprising:

a refrigeration circuit including a compression unit, a gas cooler, an expansion mechanism, and an evaporator interconnected with pipes; and a sub-compression mechanism driven by power recovered by the expansion mechanism, wherein a suction side of the sub-compression mechanism is connected to a compression process of the compression unit, a discharge side of the sub-compression mechanism is connected to an inlet side of the gas cooler, and flow rate of refrigerant flowing into the sub-compression mechanism is controlled.

2. The refrigeration cycle apparatus of claim 1, the compression unit further comprising a plurality of compressors connected by refrigerant pipes in series, the refrigeration cycle apparatus wherein the suction side of the sub-compression mechanism is connected to the refrigerant pipe which connects the compressor, the flow rate of the refrigerant flowing into the sub-compression mechanism is controlled by a rotation speed of the compressor positioned on the downstream side of the refrigerant pipe to which the inlet side of the sub compressor is connected.

3. The refrigeration cycle apparatus of claim 1, the compression unit further comprising at least one compressor, the refrigeration cycle apparatus wherein a compression mechanism of the compressor is provided with a sub-discharge port communicating with the compression process of the compression mechanism, and an inlet side of the sub-compression mechanism is connected to the sub-discharge port.

4. The refrigeration cycle apparatus of claim 3, wherein volumetric flow rate control means configured to control the flow rate of the refrigerant flowing into the sub-compression mechanism is provided between the sub-compression mechanism and the compressor to which the sub-compression mechanism is connected.

5. The refrigeration cycle apparatus of claim 4, wherein the volumetric flow rate control means is a variable expansion device.

6. The refrigeration cycle apparatus of claim 4, wherein the volumetric flow rate control means is an intermediate cooler.

7. The refrigeration cycle apparatus of claim 2, wherein the refrigerant pipe to which the sub-compression mechanism is connected is provided with an intermediate cooler on the upstream side of a connecting portion between the refrigerant pipe and the sub-compression mechanism.

8. The refrigeration cycle apparatus of claim 1, wherein carbon dioxide is used as a refrigerant.

* * * * *